US005203611A

United States Patent [19]

Greenwood

[11] Patent Number: 5,203,611

[45] Date of Patent: Apr. 20, 1993

[54] INFANT BOUNCE AND ROCKING CHAIR

[75] Inventor: Mark H. Greenwood, Arlington Hts., Ill.

[73] Assignee: Children On The Go, Inc., Wheeling, Ill.

[21] Appl. No.: 779,717

[22] Filed: Oct. 21, 1991

[51] Int. Cl.[5] ..... A47C 7/02; A47C 13/10

[52] U.S. Cl. ..... 297/457; 297/275; 297/441; 297/295

[58] Field of Search ..... 297/454–457, 297/229, 218, 130, 224, 223, 285, 294, 295, 296, 297, 302, 303, 326, 327, 274, 275, 260, 44 T; 248/629; 5/104, 105

[56] References Cited

U.S. PATENT DOCUMENTS

| | | | |
|---|---|---|---|
| D 141,221 | 5/1945 | Rapson . | |
| 888,224 | 11/1968 | Clemons . | |
| 1,317,580 | 10/1919 | Kanode . | |
| 2,269,834 | 1/1942 | Wagner . | |
| 2,440,979 | 5/1948 | Schneider . | |
| 2,495,482 | 1/1950 | Rogatz | 297/441 X |
| 2,776,700 | 1/1957 | Potter et al. . | |
| 2,848,440 | 8/1958 | Chernivsky | 297/467 X |
| 3,017,220 | 1/1962 | Chernivsky | 297/467 |
| 3,110,519 | 11/1963 | Chernivsky | 297/285 |
| 3,235,306 | 2/1966 | Chernivsky | 257/467 |
| 3,547,491 | 12/1970 | Bovasso . | |
| 4,049,314 | 9/1977 | McGaffin | 297/441 X |
| 4,079,991 | 3/1978 | Harris . | |
| 4,188,678 | 2/1980 | Rawolle | 297/438 X |
| 4,285,543 | 8/1981 | Clark . | |
| 4,553,786 | 11/1985 | Lockett, III et al. | 257/457 X |
| 4,593,950 | 6/1986 | Infanti . | |

FOREIGN PATENT DOCUMENTS

| | | | |
|---|---|---|---|
| 661655 | 7/1929 | France | 297/3 |
| 2164249 | 3/1986 | United Kingdom | 297/295 |

*Primary Examiner*—James R. Brittain
*Assistant Examiner*—James M. Gardner
*Attorney, Agent, or Firm*—Olson & Hierl, Ltd.

[57] ABSTRACT

A chair structure provided which can be used by young children either as a bouncer or as a rocker. The structure is defined by a frame member having a pair of transversely spaced, generally U-configured side portions and at least one seat member raised above a support surface. The frame member is oscillatable or rockable depending upon which one of the opposite end portions thereof is engaged with the support surface. Preferably, the structure incorporates a unitary frame member and single seat cover member that is adapted to slip over either opposite end region of the frame member, whichever one of the end regions is positioned uppermost relative to a floor surface. In one orientation, straightened portions of the frame member are floor engaged causing the upper frame portions to be vertically oscillatable. In a reverse orientation, curved portions of the frame member are floor engaged causing the upper frame portions to be horizontally and reversibly tiltable.

22 Claims, 2 Drawing Sheets

FIG. 1
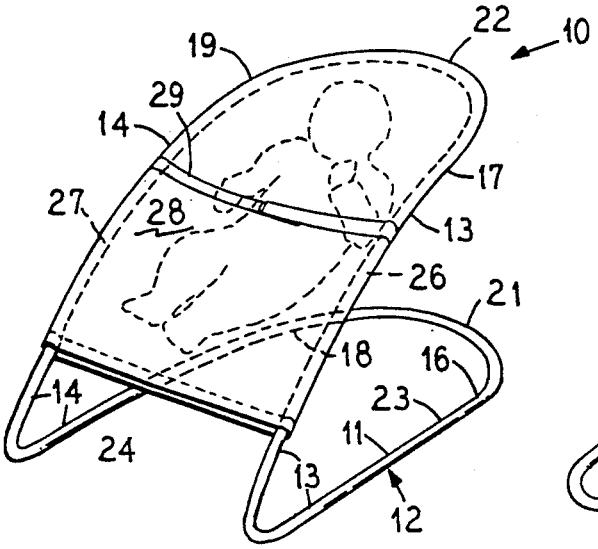
FIG. 2
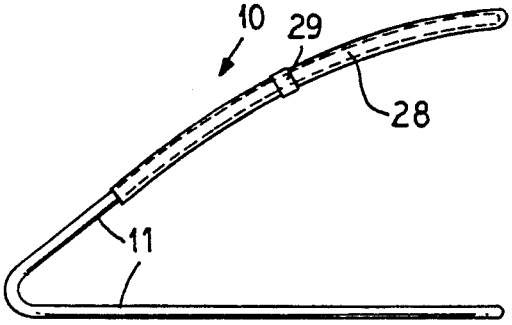
FIG. 3
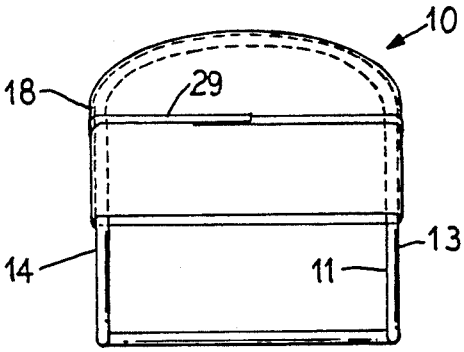
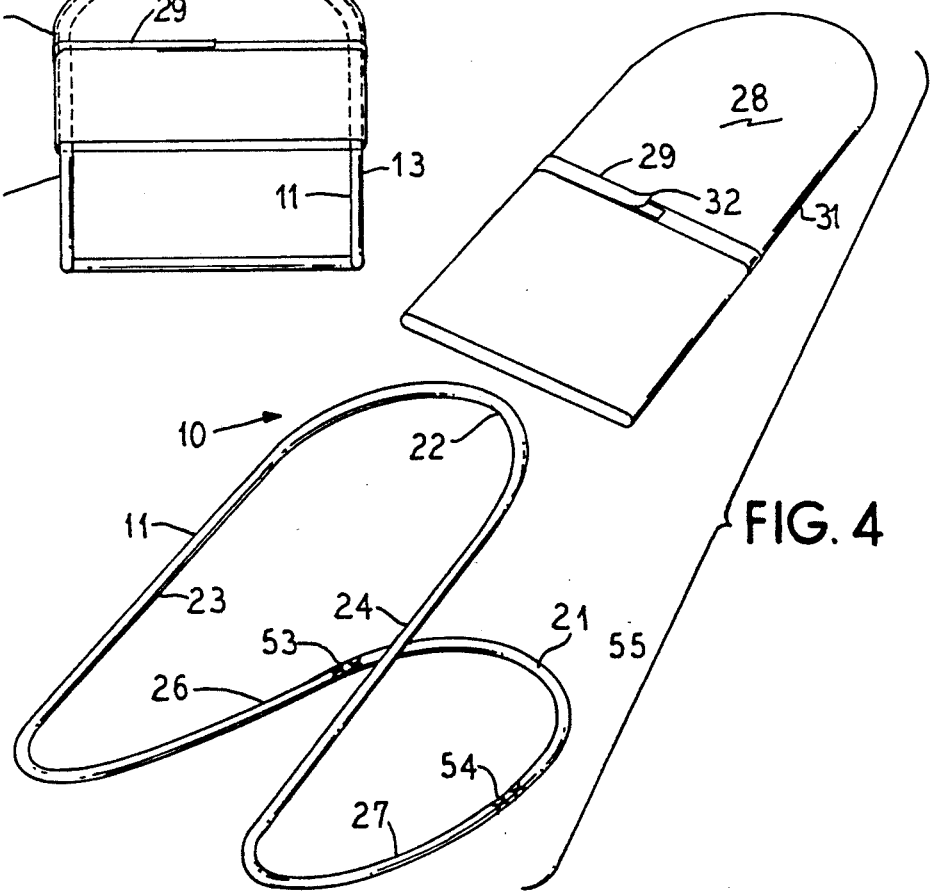
FIG. 4

INFANT BOUNCE AND ROCKING CHAIR

FIELD OF THE INVENTION

The present invention relates to chair structures which can be used either as rockers or as bouncers by young children.

BACKGROUND

Chair structures suitable for use by young children and which can function in more than one operational mode to provide amusement and hold user interest have been proposed. These structures have generally been formed of multiple sheet members, each comprised of formed sheets of plywood or the like.

For example, U.S. Pat. No. 2,776,700 to Potter et al. and U.S. Pat. No. 4,593,950 to Infanti disclose chair structures operable as a rocker in one position and as a chair in a reverse position. However, each structure employs multiple flat members as structural components of the assembled chair. U.S. Pat. No. 3,547,491 to Bovasso, U.S. Pat. No. 2,440,979 to Schneider and U.S. Pat. No. 2,269,834 to Wagner disclose comparable chair structures.

So far as now known, however, there has not previously been available a multi-functional chair structure comprised of only a single shape retaining, resilient, closed, generally U-shaped frame member and a seat cover which is engagable with the frame member at either one of two frame locations, the particular choice of location for cover engagement being determined by the orientation of the frame member.

BRIEF SUMMARY OF THE INVENTION

This invention relates to a chair structure which can be used either as a rocker or as a bouncer to support an infant.

The chair structure of the present invention is defined by a frame member having a pair of transversely spaced, generally U-configured side portions. At least one fastener portion can connect the side portions together in a generally parallel fashion. The frame member has at least one seat member raised above a support surface. Coupled to the frame member is a means for oscillating and rocking the seat member.

Preferably, chair structure has a continuously extending, unitary, shape-retaining, resilient frame member that is located along the structure periphery. The structure incorporates a pair of transversely spaced, parallel, generally U-configured side portions which are interconnected together at each of their respective opposite adjacent ends by an interconnecting section. Each interconnecting section is preferably curved and is most preferably semicircular in configuration. The frame member is comprised of a rigid, resilient, sturdy material, such as tubular steel, rod steel, glass fiber reinforced plastic rod, or the like.

One arm of each U-configured frame side portion extends straight while the other arm thereof is curved. Thus, when both straight arms of the side portions engage the floor, the curved arms are elevated and provide a seating platform support that can vertically oscillate in a spring-like manner utilizing the resilient capacity of the frame member. Yet, when both curved arms engage the floor, the straight arms are elevated and provide another or second seating platform support that is horizontally and reversibly tiltable with the curved arms being utilized as rocker rails.

The chair structure also incorporates a single seat cover that is cooperatively engagable with either of the seating platform supports. The cover is conveniently comprised of fabric (woven or non-woven), plastic sheeting, mixtures thereof, or the like, and preferably has a flexible, tubular type of construction which preferably is closed at one end in a sock-like configuration. The seat cover is slidably extendable over either opposite end region of the frame member, the end region chosen being the one which is adjacent the uppermost one of the two seating platform supports.

Preferably, the seat cover also includes a transversely positioned strap or seat belt member that is longitudinally (relative to the belt member) somewhat elastic and that extends across a mid-region of one side of the seat cover. The seat belt member is adapted for body retention and support of an infant seated upon a seat cover which has been extended over the uppermost one of the seating platform supports of the frame member.

For purposes of packaging, storing, selling, transporting and the like, the unitary frame member is preferably provided with a pair of joints, one in each U-configured frame side portion adjacent the acute U-curvature, each joint being preferably in generally transversely spaced, parallel relationship to the other thereof. Thus, an assembled frame member is preferably readily broken down into two pieces for such purposes, yet can be subsequently reassembled and used.

The chair structure thus provided is simple, durable and lightweight. It is well suited for use by, and the amusement of, young children, yet is safe and effective for such purposes.

The chair structure avoids the inconvenience and problems inherently associated with prior art chair structures wherein the frame structure is comprised of a multiplicity of shaped flat members.

Other and further objects, features, advantages and embodiments will be apparent to those skilled in the art from the attached drawings, accompanying specification and appended claims.

BRIEF DESCRIPTION OF THE DRAWINGS

In the drawings, which comprise a portion of this disclosure:

FIG. 1 is a perspective view of one embodiment of a chair structure according to the present invention shown positioned for use a bouncer showing in phantom an infant positioned thereon;

FIG. 2 is a side elevational view of the embodiment show in FIG. 1;

FIG. 3 is a front end elevational view of the embodiment shown in FIG. 1;

FIG. 4 is a view similar to FIG. 1, but with the chair structure shown in an inverted orientation for use as a rocker, and with the seat cover thereof separated, but spatially positioned for slidable mounting over the uppermost seating support of the frame member;

DETAILED DESCRIPTION

Figure 5:
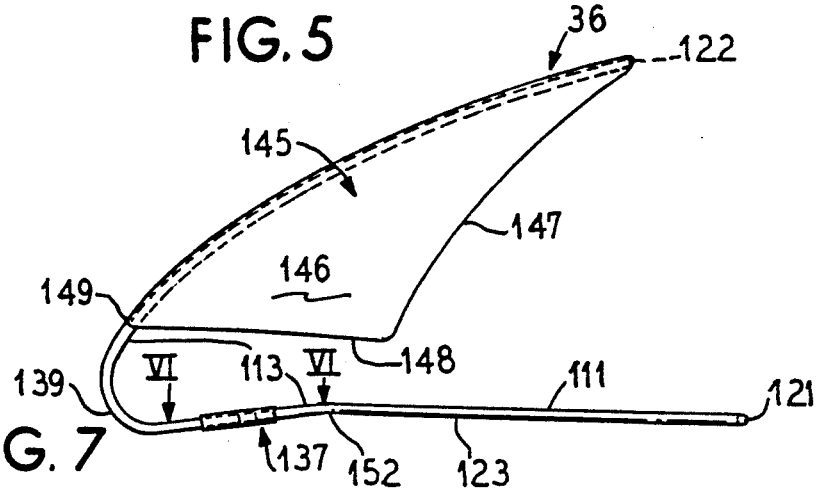
FIG. 5 is a view similar to FIG. 2, but showing an alternative embodiment of a chair structure according to the present invention.

Referring to FIGS. 1–4, one embodiment 10 of a chair structure of the present invention is presented. Chair structure 10 is well adapted for use by a young child.

The chair structure 10 incorporates a unitary, continuously extending, shape-retaining, resilient frame member 11 that is located (i.e., positioned) along the periphery 12 of chair structure 10. The frame member 11 incorporates a pair of generally U-configured side portions 13 and 14, respectively, which extend in a transversely spaced, parallel relationship to one another.

Interconnecting each one of the respective opposite adjacent ends 16 and 17, and 18 and 19, of the U-configured portions 13 and 14 is a pair of end portions 21 and 22. The end portions 21 and 22 can each have various configurations, if desired. However, it is presently preferred that the end portions 21 and 22 be similarly configured relative to each other and that each be outwardly curved relative to the chair structure 10 at the ends 16, 17 and 18, 19. More preferably, and as shown, the end portions 21 and 22 are each generally semicircular curved.

Other means of fastening or interconnecting together the pair of U-configured side portions 13 and 14 are contemplated by the present invention. For example, instead of end portion 21 or 22, a fastener portion (not shown) can extend between U-configured side portions 13 and 14 near the U-shaped curve. In that manner, the fastener portion would not interfere with the comfort of a young child using the chair structure 10 and one or both of the end portions 21 and 22 would not be needed. Thus, the ends of the frame member 11 are open.

As shown in FIG. 1, one arm of each U-configured portion 13 and 14, identified herein as arm 23 of U-configured side portion 13 and as arm 24 of U-configured side portion 14, extends generally straight relative to the side profile of the chair structure 10. The other arm of each U-configured portion 13 and 14, identified herein as arm 26 of U-configured side portion 13 and as arm 27 of U-configured side portion 14, extends generally in an outward convex curve relative to the side profile of chair structure 10.

When the frame member 11 is oriented as shown in FIG. 1 so that the straight arms 23 and 24 engage the floor or other support surface, the curved arms 26 and 27 are elevated thereover and cooperate to define a seat member or more specifically in this embodiment, a seating platform support. Conversely, when the frame member 11 is oriented as shown in FIG. 4 so that the curved arms 26 and 27 are floor engaged, the straight arms 23 and 24 are elevated thereover and cooperate to define another seating platform support. Thus, the invention contemplates at least one seat member connected to the frame member 11 which is raised above the support surface.

The frame member 11 is preferably comprised of a single material along its length. Various materials can be used. A presently preferred material is tubular resilient steel or aluminum alloy. Another convenient material is bar steel. Conventional forming procedures can be used to shape the selected material into a desired frame structure 11. While a particular configuration for a frame structure 11 is shown and illustrated herein, those skilled in the art will readily appreciate that variations are possible within the spirit and intent of the present teachings and disclosure.

Preferably, a frame member 11 is comprised of a single piece of starting material; however, more than one piece can be used. At all locations of abutment, the adjoining pieces are associated or connected together so that the resulting frame member 11 is unitary. Any convenient joining means can be utilized. In the case of a metal such as steel, it is presently preferred to join abutting members together by welding. However, interengaging piece coupling members can be used, if desired, such as one of the known types (not shown) which are adapted to seat and be positioned interiorly within (or outside of) hollow abutting member end portions.

The chair structure 10 also incorporates a seat cover 28 which is flexible and which resembles a flattened tube in configuration so as to be slidably extendable over each one of the respective adjacent ends 16 and 17, and 18 and 19, of the respective adjacent, spaced U-configured side portions 13 and 14. When so extended, the seat cover 28 covers at least a portion of one of the seating platform supports. Seat cover 28 preferably has one closed end; thus, such a seat cover 28 conveniently has a sock- or bag-like configuration as shown.

When so slidably extended over an opposite end region of frame member 11, the seat cover 28 preferably form fits and overrides the curvature of an end portion 21 or 22. Thus, the closed end of the seat cover 28 mates with the respective end portion 21 or 22 when the seat cover 28 is fully extended thereover. Conveniently and preferably, the seat cover 28 is comprised of a sheet or sheet-like material or combination of such materials which is at least somewhat resilient so that the cover 28 is adapted to be yieldingly extendable and slightly stretched between portions of the respective U-configured side portions 13 and 14.

Preferably, and conveniently, the seat cover 28 is comprised of a woven fabric material, such as cottons, or the like, but non-woven, fabric-like materials can be used, if desired. Preferably, the seat cover 28 is a polyester filled cotton fabric. Although a Terry-cloth, quilted or sewn fabric also can be used. The seat cover 28 with characteristics as indicated herein can have any convenient or desired configuration or structural composition, as those skilled in the art will appreciate.

The seat cover 28 is preferably, and as shown, equipped with a transversely extending belt member 29 which extends across a mid-region of one side of seat cover 28. The belt member 29 is preferably longitudinally elastic. Preferably, a combination of an elastic extension of belt member 28 and a localized depression of the seat cover 28 is provided in the region of belt member 29. The legs of a child user (see child shown in phantom in FIG. 1) of chair structure 10 are extendable therebetween so that the belt member 29 extends, for example, across the waist or chest region of the child who is seated or lying upon the seat cover 28. Thus, the seat cover 28 and the belt member 29 can cooperate to provide body retention and support.

Many arrangements for belt member 29 are possible. The belt member 29 can extend continuously across one side of seat cover 28 with opposite ends thereof held by stitches, adhesive, or the like (not detailed) along a seam located at each side 31 of cover 28 which seam is adapted to be adjacent to frame member 11 in an assembled configuration. The belt member 29 can alternatively be comprised of two separate sections whose adjoining ends overlap and connect together along a mid overlapping region. A "Velcro"- type hook and loop fastening means can provide a suitable interconnection in the overlap region, such as shown by the belt configuration 32 shown, for example, in FIGS. 1, 3 and 4. Alternatively, a buckle (not shown) can be employed to detachably interconnect the adjacent belt ends.

The chair structure 10 is usable either as a bouncer or as a rocker. Thus, on the one hand, when both straight arms 23 and 24 are floor engaged, as shown, for example, in FIGS. 1-3, with both curved arms 26 and 27 being elevated, and with the seat cover 28 slidably extended over the curved arms 26 and 27, the chair structure 10 is vertically oscillatable, or bounceable, by a child astride the seat cover 28 owing to the resilient spring-like character of the frame member 11.

On the other hand, when both curved arms 26 and 27 are floor engaged, as shown, for example, in FIG. 4, with both straight arms 23 and 24 elevated thereover and with the seat cover 28 slidably extended over the straight arms 23 and 24, the chair structure 10 is horizontally and reversibly tiltable, or rockable, by a child astride the seat cover 28, owing to movement of the chair structure 10 upon the curved arms 26 and 27 which act as rocker rails. The extent of curvature of arms 26 and 27 is selected (as shown in the drawings) so that the chair structure can gently rock or roll back and forth and still remain stable so that the structure does not tip over during use.

Other means coupled with the frame member 11 for oscillating and rocking the seat member are contemplated by the present invention. Such means include, but are not limited to, springs, cams, levers, torsion bars and other devices that can be attached to or made integral with the frame member 11. The spring-action of these means oscillates the seat member in a direction generally vertical to the support surface.

The means for oscillating and rocking the seat member can also include a stabilizing means that prevents the seat member from rocking in a direction generally horizontal to the support surface by locking curved arms 26 and 27 in one position. Preferably, this locking feature is reversible. Locking the curved arms 26 and 27 in one position is desirable to provide a stable base or if oscillating in a vertical direction is necessary.

One example of the stabilizing means is illustrated in FIG. 4. Hinges 53 and 54 may be incorporated in curved arms 26 and 27, respectively. In the position illustrated, the curved arms 26 and 27 form rocker arms as previously discussed. To stabilize the curved arms 26 and 27 so that they do not rock, the hinges 53 and 54 release and rotate in the direction of arrow 55 so that end portion 21 engages the floor or other support surface. In this secondary position, the curved arms 26 and 27 can not rock because end portion 21 is also resting on the floor. A stable base is provided for the seat member to oscillate in a generally vertical direction to the floor, if desired.

Figure 7:
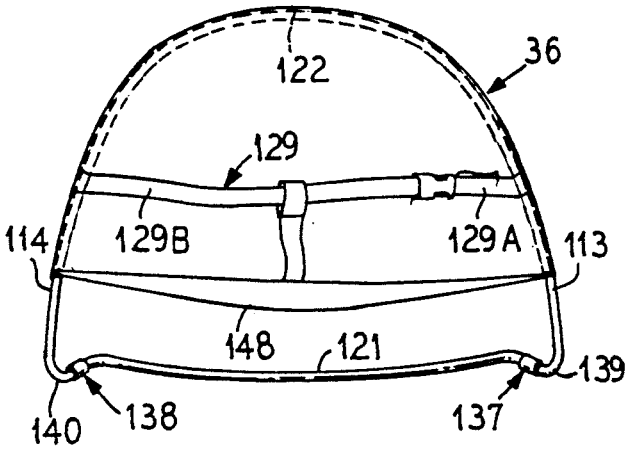
FIG. 7 is a elevational view of the embodiment shown in FIG. 5.
Figure 6:
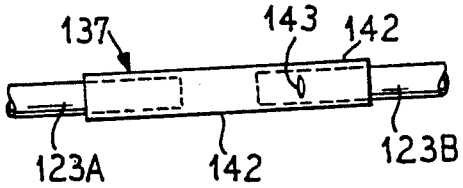
FIG. 6 is an enlarged partial detailed view of the frame joint structure shown in the region VI—VI of FIG. 5, some parts thereof being broken away and some parts thereof being shown in phantom.
Figure 8:
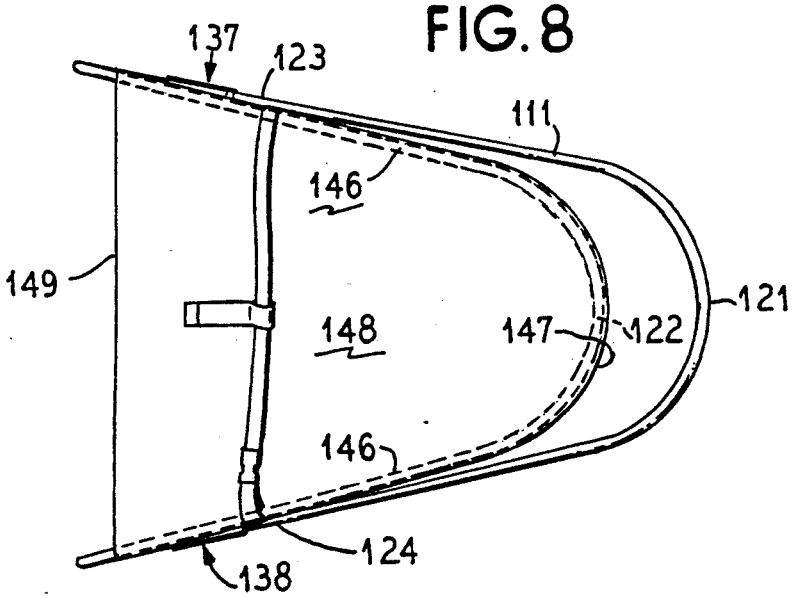
FIG. 8 is a top plan view of the embodiment shown in FIG. 5.

Referring to FIGS. 5-8, another embodiment 36 of a chair structure of the present invention is presented. Although chair structure 36 employs different, but likewise illustrative, component configurations, compared to chair structure 10, corresponding elements are similarly numbered, but with the addition of the numeral "1" initially thereby converting each prior two-digit number into a three-digit number.

In chair structure 36, each of the U-configured side portions 113 and 114 is angularly disposed relative to the other thereof. Thus, the widest transverse spacing therebetween occurs in the respective forward regions 139 and 140 of highest (greatest) curvature rate of each such side portion 113 and 114. The least transverse spacing therebetween occurs at the indistinctly defined opposite adjacent ends of the U-configured side portions 113 and 114 where such ends interconnect with outwardly curved end portions 121 and 122.

Each of the respective arms 123 and 124 is provided with a joint 137 and 138 in a location thereof which is adjacent the region 139 and 140 of high curvature rate in each of the respective U-configured side portions 113 and 114. Preferably, and as shown, each joint 137 and 138 is located so as to be in generally transversely spaced parallel, aligned relationship relative to the other thereof.

While a joint 137 and 138 can have any convenient or desired structure, joint structures which are adapted to releasably engage adjacent abutting frame end portions are preferred. One presently most preferred joint structure is employed in each joint 137 and 138, and the structure is illustrated with reference to joint 137 in arm 123 in FIG. 6. Arm 123 is transversely cut, producing a forward section 123A and a rearward section 123B.

In embodiment 36, frame 111 is preferably comprised of a tubular metal, such as a steel, a magnesium alloy, or the like. Over the outside end portion of rearward section 123B, one end of a tubular sleeve 142 is extended. Preferably the inside diameter of sleeve 142 is such as to make sliding engagement with outside surface portions of arm 123.

When sleeve 142 is thus positioned over end portion of section 123B, it can be fixed thereto by any convenient means, including welding, an adhesive, or the like. For example, in the embodiment shown, sleeve 142 can be so fixed by staking sleeve 142 to such end portion of section 123B which typically leaves a visibly discernable stake mark or depression 143 in sleeve 142 located radially over an area of the end portion. The opposite end of sleeve 142 is then slidably engagable over the forward section 123A.

A present preference is to form the respective ends of sections 123A and 123B so that, with the sleeve 142 engaged with section 123B, the open end of sleeve 142 does not align with the end of section 123A in a relaxed configuration. Thus, when assembling an embodiment 36, the user must put slight manual pressure on the rod section 123A and on the tubular sleeve 142. The misalignment is preferably such that the pressure must be exerted inwardly so as to bring sleeve 142 into engageable alignment with the end of rod section 123A. After slidable engagement of sleeve 142 over the end of rod section 123A is achieved, the two sections 123A and 123B are held in place by the spring tension created when the user releases his hold on section 123A and on sleeve 142. Disassembly can subsequently be accomplished by the same bending pressure.

Thus, section 123A is releasably engagable in an abutting-type association with section 123B in a simple, effective and reliable manner. Hence, frame 111 is readily assembled or disassembled using two such joints 137 and 138 in respective arms 123 and 124. The two separated pieces for frame 111 are desirable for purposes of packaging, storing, selling, transporting and the like a chair structure of the invention.

The chair structure 36 utilizes a seat cover 145 in place of seat cover 28. The seat cover 145 can be comprised of materials similar to those employed in seat cover 28, but is structured so as to include, when seat cover 128 is slidably fully engaged over an uppermost opposite end portion 121 or 122, integrally associated side and back wall portions 146 and 147 which slope downwardly and terminate peripherally about side and back edge portions of a seat portion 148 which is generally horizontally oriented with preferably a sag in its mid region.

Extending transversely across an upper edge region of seat cover 145 in spaced relationship to the forward edge 149 thereof is a seat belt 129 which can be structured similarly to belt 29, but which is here illustratively provided with a buckle 151 offset from the mid-region thereof for joining together separate belt sections 129A and 129B. An infant is positioned in a seated position in seat cover 145 upon seat portion 148 with feet and lower legs hanging over the forward edge 149 thereof.

The generally straight arms 123 and 124 of the chair structure 36 in the illustrative form shown are each provided with a bend, such as bend 152 in arm 123. Each bend is correspondingly positioned in each arm 123 and 124. These bends cause opposite end regions of each respective arm 123 and 124 to be floor engagable while mid-regions thereof are elevated relative to the floor. This bend, such as bend 152 in arm 123, provide the structure 36 with flexural characteristics that enhance "bouncing" motion. The stability of the chair structure 36 is also enhanceable when the chair structure is oriented with the arms 123 and 124 lowermost and floor engaged.

The invention has now been described in illustrative embodiments and accompanying text, but many modifications of arrangements, proportions, elements, materials, components and the like will be apparent, such as for various uses, environments, and operational situations, to those skilled in the art from the present description without departing from the scope of this invention.

What is claimed is:

1. A chair structure for use either as a bouncer or as a rocker upon a support surface, said chair structure comprising:

(a) a continuously extending frame member that generally defines the perimeter of said chair structure, said frame member having a pair of transversely spaced, longitudinally extending, generally U-configured side portions, each one of said U-configured side portions including a pair of interconnected arms, the corresponding arms of each one of said arm pairs being in opposed, transversely spaced relationship relative to the other so as to provide first and second pairs of corresponding arms;

said frame member further having a pair of generally transversely extending end portions, each one of said end portions being in opposed, spaced relationship relative to the other, each one of said end portions being interconnected to a terminal region of a different one of said corresponding arms of said first and second arm pairs; and (b) a seat member comprised of flexible sheet material which is engageable with either one of said first and second arm pairs;

the corresponding arms of said first arm pair having a vertically outwardly curved profile so that, when said first arm pair is engaged with said support surface, said chair structure is rockable; and the corresponding arms of said second arm pair having a profile such that each one of said corresponding arms includes at least two longitudinally spaced locations that are simultaneously engageable with said support surface when said second arm pair is engaged with said support surface so that, when so engaged, said chair structure is vertically oscillatable.

2. The chair structure of claim 1 wherein said frame member comprises a material which is resilient and shape-retaining.

3. The chair structure of claim 1 wherein the frame member further includes a pair of hinges, one in each of the curved arms, the pair of hinges being reversibly lockable in at least two positions, so that in one position each curved arm forms a rocker rail, nd in a second position each curved arm is broken and the end of each curved arm swings down to engage the floor support.

4. The chair structure of claim 1 wherein said seat member is slidably extendable over each one of said corresponding arm pairs.

5. The chair structure of claim 1 wherein said frame member includes a pair of joints, one in each U-configured side portion, so that the frame member comprises a pair of frame potions which are releasably engageable with one another at abutting portions.

6. A chair structure for use as either a bouncer or a rocker comprising in combination:

(a) a continuously extending, shape-retaining, resilient frame member defining the periphery of said chair structure, said frame member incorporating (i) a pair of transversely spaced, generally U-configured side portions, each U-configured side portion including a pair of arms, and (ii) a pair of end portions each one of which interconnects together each of the respective opposite adjacent ends of said U-configured side portions, one arm of each U-configured side portion extending generally straight, the other arm of each U-configured portion extending generally curved; and (b) a seat cover which is slidably extendable over each one of said opposite ends of said respective U-configured side portions;

so that when both of said straight arms are floor engaged, both of said curved arms are elevated, and said seat cover is extended over said curved arms, then said chair structure is vertically oscillatable by a child astride said seat cover, and when both of said curved arms are floor engaged, both of said straight arms are elevated, and said seat cover is extended over said straight arms, then said chair structure is horizontally and reversibly tiltable by a child astride said seat cover.

7. The chair structure of claim 6 wherein each of said end portions is outwardly curved.

8. The chair structure of claim 7 wherein each of said end portions is hemicircularly outwardly curved.

9. The chair structure of claim 6 wherein said seat cover has one closed end.

10. The chair structure of claim 9 wherein said seat cover is comprised of a resilient material which yieldingly engages spaced adjacent regions of said U-configured side portions when said seat cover has been so extended over either one of said opposite ends.

11. The chair structure of claim 6 wherein said seat cover additionally includes a transversely extending belt member across a mid-region of one side thereof.

12. The chair structure of claim 11 wherein said belt member is longitudinally slightly elastic and is secured at each of its respective opposite ends to an adjacent portion of said seat cover.

13. The chair structure of claim 12 wherein said belt member is comprised of two elongated portions which are adapted to overlap at a mid-portion of said seat cover, and wherein securing means is provided to join said mid-portions together detachably and adjustably.

14. The chair structure of claim 6 wherein said seat cover is comprised of woven fabric.

15. The chair structure of claim 6 wherein said seat cover is comprised of non-woven fabric.

16. The chair structure of claim 6 wherein said frame member is comprised of tubular steel.

17. The chair structure of claim 6 wherein said frame member is comprised of bar steel.

18. The chair structure of claim 6 wherein said frame member includes a pair of joints, one in each U-configured frame side portion, so that said frame member comprises a pair of frame portions which are releasably engagable with one another at abutting portions.

19. The chair structure of claim 6 wherein each of said generally straight arms includes a bend means therein so that respective opposite end regions thereof are floor engagable while mid-regions thereof are elevated relative to the floor.

20. The chair structure of claim 6 wherein said U-configured side portions are generally in parallel relationship relative to one another.

21. The chair structure of claim 6 wherein said U-configured side portions are generally in skewed relationship with one another with the spacing transversely therebetween being greatest in the respective forward regions of greatest curvature rate thereof.

22. The chair structure of claim 6 wherein said seat cover, when slidably extended over one of said opposite ends of said respective U-configured side portions, includes side, back and seat portions defined therein.

* * * * *